United States Patent [19]

French

[11] 4,239,285

[45] Dec. 16, 1980

[54] METHOD OF ATTENUATING AIRBLAST FROM DETONATING EXPLOSIVE IN AN IN SITU OIL SHALE RETORT

[75] Inventor: Gordon B. French, Bakersfield, Calif.

[73] Assignee: Occidental Oil Shale, Inc., Grand Junction, Colo.

[21] Appl. No.: 50,425

[22] Filed: Jun. 20, 1979

Related U.S. Application Data

[63] Continuation of Ser. No. 840,856, Oct. 11, 1977.

[51] Int. Cl.[3] ..... E21C 41/10

[52] U.S. Cl. ..... 299/2; 102/23; 299/13

[58] Field of Search ..... 299/2, 13; 166/299; 102/23, 30

[56] References Cited

U.S. PATENT DOCUMENTS

| | | | |
|---|---|---|---|
| 1,842,664 | 1/1932 | Elsing | 299/13 X |
| 2,704,515 | 3/1955 | Barlow | 102/23 |
| 3,917,346 | 11/1975 | Janssen | 299/2 X |
| 3,980,339 | 9/1976 | Heald et al. | 299/2 |

*Primary Examiner*—Ernest R. Purser

*Attorney, Agent, or Firm*—Christie, Parker & Hale

[57] ABSTRACT

An in situ oil shale retort is formed in a subterranean formation containing oil shale and including underground workings by excavating a means for access to a retort site in the formation, excavating a void in the retort site at least in part from the means for access, leaving a remaining portion of the unfragmented formation in the retort site adjacent the void, placing explosive in the remaining portion of formation, and detonating the explosive in such unfragmented formation in a single round to explosively expand formation toward the void for forming a fragmented permeable mass of formation particles containing oil shale in an in situ retort. A permeable barrier is provided between the void and the underground workings which provide means for access to such a void. The permeable barrier has a cross-section for gas flow which is substantially smaller than the transverse cross-section of such means for access, and the cross-section of such permeable barrier temporarily confines gas from such explosive expansion and limits flow of such gas to such means for access to attentuate airblast in underground workings. A fragmented permeable mass of formation particles produced during excavation of the void can provide such a permeable barrier.

41 Claims, 4 Drawing Figures

METHOD OF ATTENUATING AIRBLAST FROM DETONATING EXPLOSIVE IN AN IN SITU OIL SHALE RETORT

CROSS REFERENCE TO RELATED APPLICATIONS

This is a continuation of application Ser. No. 840,856, filed Oct. 11, 1977.

BACKGROUND OF THE INVENTION

This invention relates to in situ recovery of shale oil and, more particularly, to techniques for attenuating airblast produced when detonating large amounts of explosive for forming an in situ oil shale retort.

The term "oil shale" as used in the industry is in fact a misnomer; it is niether shale, nor does it contain oil. It is a sedimentary formation comprising marlstone deposit with layers containing an organic polymer called "kerogen" which, upon heating, decomposes to produce hydrocarbon liquid and gaseous products. The formation containing kerogen is called "oil shale" herein, and the hydrocarbon liquid product is called "shale oil".

One method for recovering shale oil is to form an in situ retort in a subterranean formation containing oil shale. Oil shale formation within an in situ retort site is fragmented to form a retort containing a fragmented permeable mass of formation particles containing oil shale. The formation particles at the top of the fragmented mass are ignited to form a combustion zone, and an oxygen-supplying gas, such as air, is supplied to the top of the fragmented mass to sustain the combustion zone and to advance the combustion zone downwardly through the fragmented mass. As the combustion zone advances through the fragmented mass, heated retorting gas forms a retorting zone on the advancing side of the combustion zone where kerogen in the formation particles is decomposed to produce shale oil and product gases. Thus, a retorting zone moves from top to bottom of the fragmented mass in advance of the combustion zone. The shale oil and product gases produced in the retorting zone pass to the bottom of the fragmented mass for collection.

U.S. Pat. No. 4,043,595, which is assigned to the same assignee as this application, discloses a method for explosively expanding formation containing oil shale to form an in situ oil shale retort. That patent is incorporated herein by this reference. According to a method disclosed in that patent, formation is excavated to form a columnar void bounded by unfragmented formation having a vertically extending free face, drilling blasting holes adjacent the columnar void and parallel to the free face, loading the blasting holes with explosive, and detonating the explosive in a single round. This expands the formation adjacent the columnar void toward the free face so that fragmented formation particles occupy the columnar void and the space in the in situ retort site originally occupied by the expanded shale prior to such explosive expansion. A room having a horizontal cross-section that coincides approximately with the horizontal cross-section of the retort to be formed is excavated so as to intersect the columnar void. The blasting holes are drilled and loaded with explosive from the room. In one embodiment, the columnar void is cylindrical and the blasting holes are arranged in concentric rings around the columnar voil. In another embodiment, the columnar void is a slot having large, parallel, planar vertical free faces toward which the formation in the retort site can be explosively expanded. The blasting holes are arranged in planes parallel to such free faces.

Explosive in such blasting holes is detonated in a time delay sequence so that unfragmented formation within the retort site is explosively expanded in segments progressing away from the free face provided by the columnar void. The sequence of blasting is rapid, and in an embodiment disclosed in U.S. Pat. No. 4,043,595, the time delays for explosively expanding formation toward the columnar void span a time period of less than 700 milliseconds. Shorter time delays can be used in other embodiments. In one embodiment, as much as 85 tons of explosive are detonated in a single round for explosively expanding formation toward a columnar void. This produces a powerful explosion which generates a large volume of gas and a resultant airblast which can travel through underground workings leading away from the blasting site. Airblast from such a powerful explosion can cause serious damage to equipment and injury to personnel in such underground workings. Equipment which can be damaged from such airblast cannot necessarily be easily or economically removed from underground workings prior to such explosive expansion. Thus, there is a need to attenuate airblast produced when detonating large amounts of explosive for forming an in situ oil shale retort.

SUMMARY OF THE INVENTION

A method is provided for attenuating airblast in adjacent underground workings produced by detonating explosive in a subterranean formation containing oil shale when forming a fragmented permeable mass of formation particles containing oil shale in an in situ oil shale retort. A means for access is excavated to a retort site in the formation containing oil shale. At least one void is excavated in the formation within the retort site, leaving a remaining portion of unfragmented formation within the retort site adjacent the void. A permeable barrier is provided between such a void and the underground workings which provide means for access to such a void. The permeable barrier has a cross-section for gas flow which is substantially smaller than the transverse cross-section of such means for access. Explosive is placed in such a portion of unfragmented formation adjacent the void, and such explosive is detonated for explosively expanding the unfragmented formation toward such a void for forming an in situ retort containing a fragmented permeable mass of formation particles containing oil shale. The cross-section of the permeable barrier confines gas from such explosive expansion and limits flow of such gas to such means for access to attenuate air-blast in the underground workings. In one embodiment, the permeable barrier comprises a fragmented permeable mass of formation particles placed in the means for access.

DRAWINGS

The features of specific embodiments of the best mode contemplated of carrying out the invention are illustrated in the drawings, in which.

Figure 4:
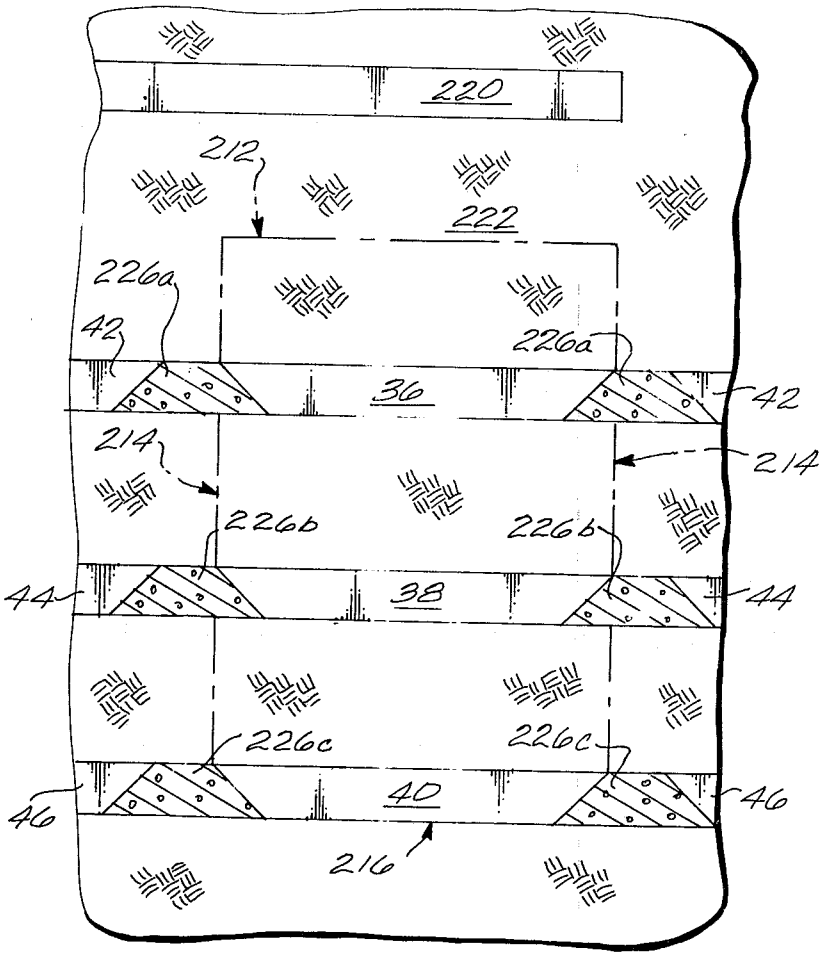
Figure 3:
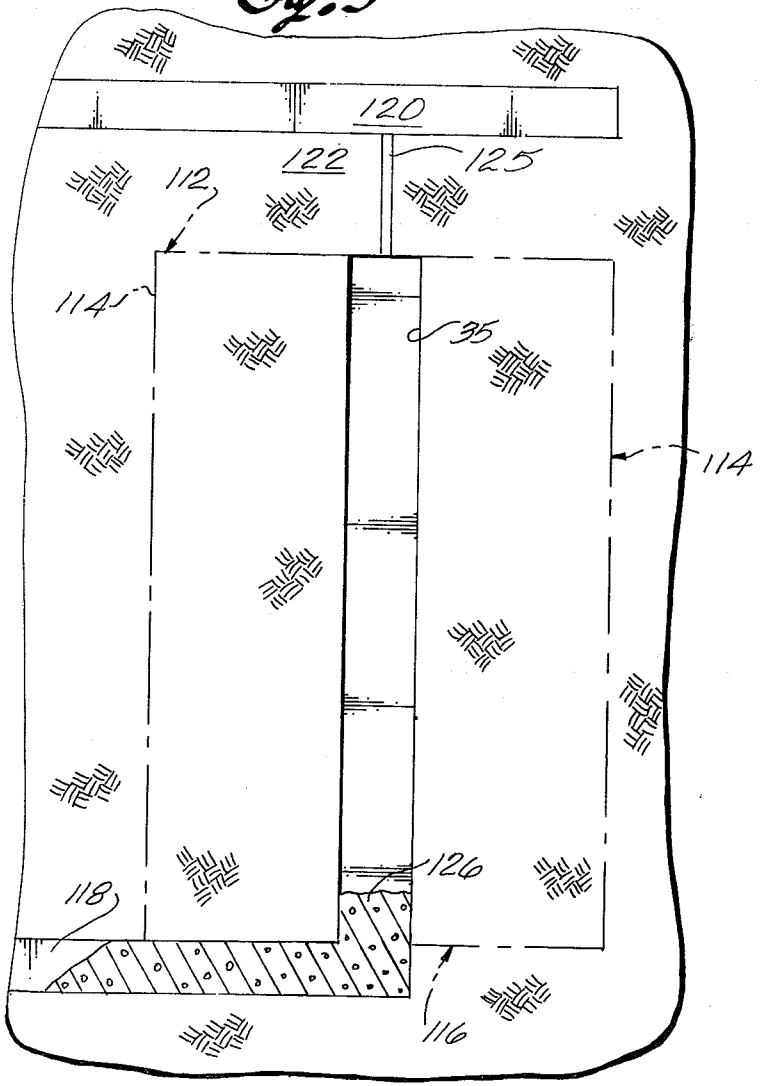

FIG. 3 is a semi-schematic cross-sectional side view showing an alternate method for forming a retort site, in which a permeable barrier is formed between a vertically extending slot in a retort site and a means for access to the retort site; and FIG. 4 is a semi-schematic cross-sectional side view showing a further alternate method of forming a retort, in which permeable barriers are formed between vertically spaced apart, horizontal rooms excavated in the retort site and drifts leading away from such rooms.

DETAILED DESCRIPTION

Figure 2:
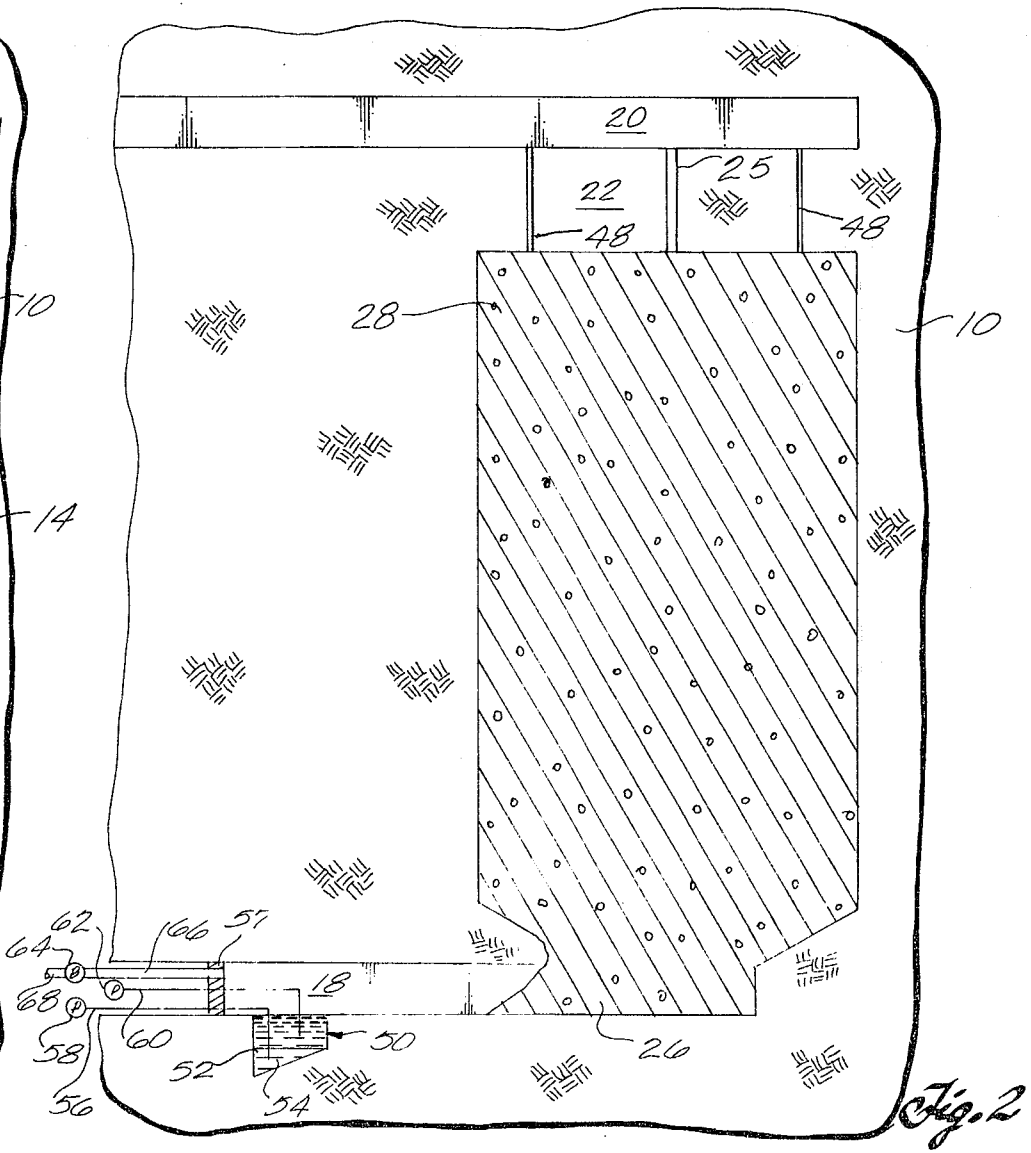
FIG. 2 is a semi-schematic cross-sectional side view showing the in situ oil shale retort of FIG. 1 after explosive expansion of formation in the retort site.
Figure 1:
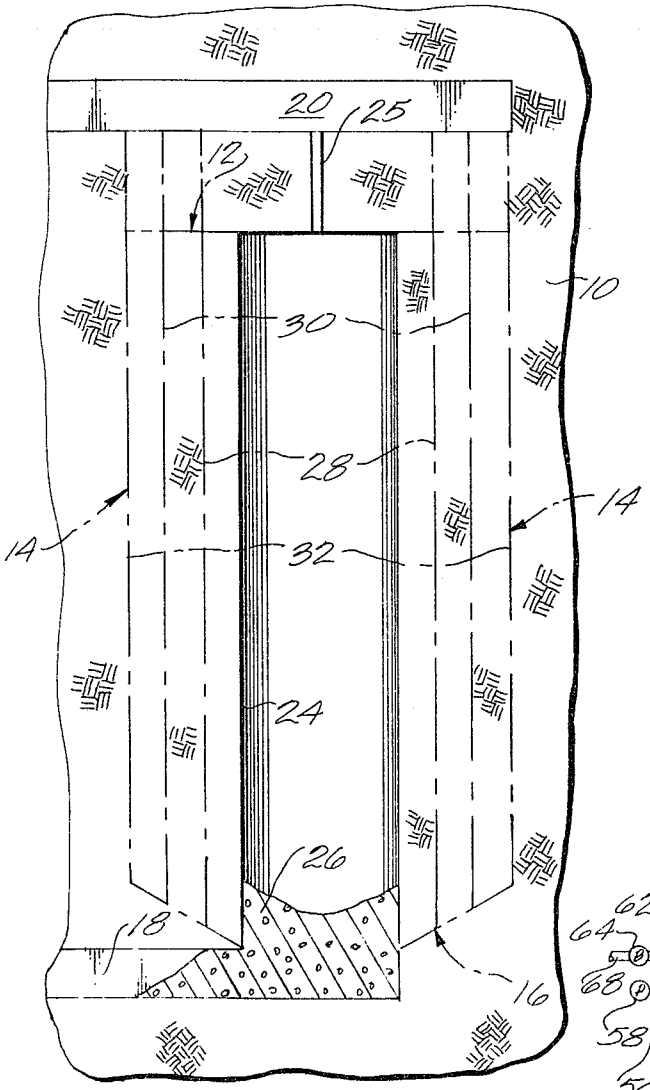
FIG. 1 is a semi-schematic cross-sectional side view showing an in situ oil shale retort in a subterranean formation containing oil shale and having a permeable barrier between a columnar void in the retort site and other underground workings.

FIGS. 1 and 2 show a subterranean formation 10 containing oil shale in which an in situ oil shale retort is being formed. The in situ retort shown in FIGS. 1 and 2 is rectangular in horizontal cross-section, and as shown in phantom lines in FIG. 1, the retort being formed has a top boundary 12, four vertically extending side boundaries 14, and a lower boundary 16. A drift 18 at a production level provides a means for access to the lower boundary of the in situ oil shale retort. Formation which is excavated to form the drift 18 is transported to above ground through an adit or shaft (not shown).

The in situ oil shale retort is formed by excavating a portion of the formation to form an open base of operation 20 on an upper working level. The floor of the base of operation 20 is spaced above the upper boundary 12 of the retort being formed, leaving a horizontal sill pillar 22 of unfragmented formation between the bottom of the base of operation and the upper boundary 12 of the retort being formed. The horizontal extent of the base of operation 20 is sufficient to provide effective access to substantially the entire horizontal cross-section of the retort being formed. Such a base of operation 20 provides an upper level means for access for excavation operations for forming a void, as well as drilling and explosive loading for explosive expanding of formation toward such a void to form a fragmented permeable mass of formation particles in the retort being formed. The base of operation 20 also facilitates introduction of oxygen containing gas into the top of the retort formed below the horizontal sill pillar 22.

According to the embodiment shown in FIG. 1, the in situ retort is prepared by excavating a portion of the formation in the retort site to form a raise or columnar void 24 which extends vertically upward from the drift 18 to the top boundary 12 of the retort being formed. In the embodiment shown in FIG. 1, the raise is cylindrical and is located in the center of the rectangular retort being formed. The raise 24 provides a cylindrical free face spaced from the side boundaries 14 of the retort being formed. For a more complete description of a technique for forming the raise 24, reference is made to the aforementioned U.S. Pat. No. 4,043,595.

One way of forming the raise 24 is to blast it out to its fullest cross-section in a series of vertical increments moving toward the top of the formation 10. Another way of forming the raise 24 is to blast it out to its full vertical height in a series of incremental layers progressing outwardly from a central bore hole. An initial vertical raise of relatively small cross-section is formed, the upper portion of which is illustrated at 25, extending from the access drift 18 upwardly for the full length of the final raise, by drilling, boring, etc. The lower portion of the initial smaller raise 25 is enlarged by drilling a closed band or series of vertical blasting holes in a ring or circle concentric with the initial raise and of the same length. Explosive is loaded into the blasting holes up to the level of the top boundary 12, the explosive is detonated, and at least a portion of the resulting fragmented mass of formation particles is removed from the bottom of the raise through the drift 18. The step of enlarging the initial raise is repeated one or more times to increase the cross-section of the initial raise to the final desired cross-section for the raise 24 in increments that will permit free flow of resulting fragmented formation particles down into the bottom of the raise in each increment.

A permeable barrier is formed between the bottom of the final raise 24 and other underground workings such as access drift 18. The permeable barrier provides a means for attenuating airblast produced when formation is subsequently explosively expanded toward the raise 24 when forming a fragmented mass of formation particles in the retort being formed. The permeable barrier can be provided by a fragmented mass of formation particles which drops into the bottom of the raise during the steps of forming the final raise 24. This forms a pile 26 of fragmented particles which blocks passage between the lower portion of the raise 24 and the drift 18. A sufficient amount of fragmented formation particles is left in the pile 26 to substantially completely block passage from the bottom of the raise 24 to the drift 18. Any excess fragmented formation particles can be removed from the pile 26 through the drift 18. Conversely, any additional fragmented formation particles needed to complete substantial blockage of the passage may be returned to the pile 26. Although it is preferable to completely block the passage, under some circumstances a pile of fragmented formation particles that blocks the passage somewhat less than completely can be used. As shown in FIG. 1, the pile 26 of fragmented formation particles occupies the lower portion of the raise 24 and also blocks the transverse cross-section of the drift 18 which opens into the bottom of the raise 24.

In an alternate embodiment of the retort shown in FIG. 1, a rectangular lower void or room (not shown) can be formed at the bottom of the retort site at the level of the production level drift 18. Such a void can have a cross-section which is similar to that of the retort being formed. In this instance, a permeable barrier, such as a pile of fragmented formation particles, can block the transverse cross-section of the lower level drift which opens into such a lower void. An embodiment having such a lower void is described in above-mentioned U.S. Pat. No. 4,043,595.

After formation of the raise 24, the retort site is prepared for explosive expansion to form the retort shown in FIG. 2. Preparation for such explosive expansion is carried out by drilling a number of coaxial rings of vertical blasting holes (represented by phantom lines 28, 30 and 32) through the portion of unfragmented formation remaining in the retort site adjacent the raise 24. The outer band of blasting holes 32 defines the vertical sides of the in situ retort being formed; and the blasting holes can be drilled to varying depths to provide a retort having a tapered bottom 16 as shown in FIGS. 1 and 2. Explosive is loaded into the blasting holes and such explosive is detonated in an outwardly progressing sequence to fragment formation adjacent the raise 24 and expand fragmented formation toward the vertical free face on the formation adjoining such a raise. This forms a fragmented permeable mass 34 of formation particles containing oil shale in the retort site. The explosive expansion step distributes the void volume of the raise 24 into the interstices between particles in the mass of fragmented formation particles remaining after explosive expansion.

The pile 26 of fragmented formation particles blocking the way to underground workings provides a protective barrier to alleviate airblast damage to equipment and injury to personnel located in underground workings which open into the portion of formation being explosively expanded. The pile 26 of fragmented formation particles provides a barrier which is permeable to gas flow and which acts as a flow restrictor by reducing the effective transverse cross-section of the drift 18 or other means of access to the void space toward which formation is explosively expanded. A powerful airblast can be generated by such explosive expansion inasmuch as the entire volume of unfragmented formation remaining within the retort site can be explosively expanded toward the raise 24 in a single round of explosions. For example, in one embodiment an in situ retort having horizontal cross-sectional dimensions of about 120 feet long and about 120 feet wide, with a height of about 250 feet, is formed by explosively expanding formation within the retort site toward a vertically extending void in a single round of explosions. The pile 26 of fragmented formation particles is sufficiently large to resist substantial movement shown subjected to the gas pressure from such a large explosion, and it is also sufficiently permeable to allow gas to flow through it and yet reduce the effective transverse cross-section of the drift 18 sufficiently that the potential airblast from detonating such a large amount of explosive is appreciably attenuated.

When explosive is detonated it transforms much of its mass from the liquid or solid state to a gaseous state. A large volume of high temperature, high pressure gas is generated in a very short time interval. The resultant gas pressure provides a moving force for fragmenting formation. Gas from the explosive cools rapidly by contact with formation particles. The large volume of gas generated by such explosive cannot be contained by an impermeable barrier, but must be allowed to dissipate by passage through underground workings, or the like. The escape of gas from the site of explosion can result in damaging airblast in underground workings. The permeable barrier between the site of the explosion and underground workings which provide a means for access to the blast site permits gas to flow more gradually and reduces the gas velocity through such underground workings. Thus, the permeable barrier serves as a flow restrictor and alleviates damaging airblast.

The permeable barrier needs to have sufficient mass or other resistance to movement to avoid appreciable displacement as a result of the gas pressure. It must have sufficient permeability to permit gas flow from the retort site to avoid excessive pressures which could cause other damage.

FIG. 3 shows an alternative technique for forming an in situ oil shale retort, in which a vertically extending columnar void is formed in the shape of a narrow elongated slot 35. The surface of the formation defining such a slot-shaped columnar void provides a pair of parallel free faces extending vertically through the retort site. The vertical slot extends upwardly from a production level access drift 118 to an upper boundary 112 of the retort being formed. The length of the slot extends essentially the entire distance between opposite side walls of the retort being formed. The slot 35 is located within the side boundaries of the retort so the long direction of the slot extends across the center of the horizontal cross-section of the retort being formed. The width or narrow dimension of the slot is located essentially in the center of the side boundaries defining the retort. The narrow dimension of the slot is shown in FIG. 3. In an embodiment such as that shown in FIG. 3, the slot is over 120 feet in length and about 18 feet wide, and over 200 feet in height. Techniques for forming the slot 35 are disclosed in U.S. Pat. No. 4,043,596, which is assigned to the same assignee as this application; and that patent is incorporated herein by this reference. Techniques for forming an in situ retort from such a vertically extending slot are also disclosed in the aforementioned U.S. Pat. No. 4,043,595.

Following formation of the slot 35 a pile 126 of fragmented formation particles is left in the bottom of the slot 35. The pile of fragmented particles blocks the passage between the bottom of the slot and the production level drift 118. In an embodiment such as that shown in FIG. 3, the particles in the bottom of the slot had a depth of about 30 feet. The fragmented particles also extend through the portion of the drift 118 which extends below the portion of unfragmented formation in the retort site to be explosively expanded toward the slot. This ensures that a permeable barrier will be present between any portion of the formation which is explosively expanded and any underground workings which provide a means for access to formation being explosively expanded. Blasting holes are drilled downwardly from an overlying base of operation 120 through unfragmented formation within the retort site adjacent the slot 35 to a lower boundary 116 of the retort being formed. The blasting holes are loaded with explosive which is detonated to explosively expand such unfragmented formation toward the free faces provided by the slot 35. This forms a fragmented permeable mass (not shown) of formation particles containing oil shale similar to the fragmented mass 34 shown in FIG. 2. Formation within the retort site is explosively expanded toward the slot 35 in a single round of explosions, which produces a powerful explosion. The pile 126 of fragmented formation particles reduces the effective cross-section of underground workings which are open to formation being explosively expanded, and the potential airblast produced by such explosive expansion is attenuated by the pile of fragmented particles in the drift.

FIG. 4 shows a further alternate method of forming a void volume within a retort site in preparation for forming an in situ retort. In the method shown in FIG. 4, three vertically spaced apart horizontal voids are formed within the boundaries of the retort site. A rectangular upper horizontal void 36 is excavated at an upper retort access level, a rectangular intermediate horizontal void 38 is excavated at an intermediate retort access level, and a rectangular lower horizontal void 40 is excavated at a lower retort access level. The horizontal cross-section of each horizontal void is substantially similar to that of the retort being formed. In the embodiment shown, a retort level access drift extends through opposite side boundaries of the retort site at each level, and each of such access drifts is centered in its respective horizontal void. Thus, an upper level retort access drift 42 extends through opposite side walls of the upper level void 36; an intermediate level retort access drift 44 opens through opposite side walls of the intermediate level void 38; and a lower level retort access drift 46 opens through opposite side walls of the lower level void 40. Each horizontal void 36, 38, 40 has a horizontal free face having an area substantially larger than the transverse cross-section of the access drifts extending to the void. Further details of techniques for forming retorts using such horizontal void volumes are more fully described in U.S. Pat. No. 4,043,597 and No. 4,043,598. These patents are assigned to the assignee of this application and are incorporated herein by this reference.

In excavating formation from the upper level void 36, fragmented formation particles are removed from the excavated void through the upper level retort access drift 42. Following completion of the upper level void, the passages formed by the upper level drift 42 coming through the opposite side walls of the upper level void 36 are backfilled with separate piles 226*a* of formation particles to block such passages. Similarly, separate backfill piles 226*b* of fragmented formation particles block the passage between the intermediate level void 38 and the portions of the intermediate level retort access drift 44 which open into the void; and separate backfill piles 226*c* of fragmented formation particles block passage between the lower level void 40 and the portions of the lower level retort access drift 46 which open into opposite sides of the lower level void.

After completing each upper, intermediate and lower level void, formation is explosively expanded toward such voids to form a fragmented permeable mass (not shown) of formation particles containing oil shale within the upper, side and lower boundaries 212, 214 and 216, respectively, of the retort. Vertical blasting holes are drilled in the zones of unfragmented formation between the upper, intermediate and lower voids. Explosive is loaded into such blasting holes and is detonated in a single round for explosively expanding the unfragmented zones toward the horizontal free faces of formation adjacent the voids. Such detonation of explosive in a single round produces a powerful explosion which could generate an airblast which would normally travel through the upper, intermediate and lower drifts. However, the piles of fragmented formation particles in the openings between the upper, intermediate and lower drifts and their corresponding voids attenuate the force of the airblast produced during such explosive expansion.

Referring again to the embodiment in FIG. 1, blasting holes 28 and other drill holes extend through the horizontal sill pillar 22 above the upper boundary 12 of the in situ oil shale retort being formed from the overlying base of operation 20. The blasting holes used in forming the raise 24 (or the slot 35 in the embodiment of FIG. 3) can be left open when formation is explosively expanded to form the fragmented mass in the retort. Blasting holes containing explosive for fragmenting formation can be stemmed in the horizontal sill pillar above the top boundary 12. Such stemming can be gravel or small particles of formation. The largest hole through the horizontal sill pillar 22 is the upper end of the initial raise 25 used as a pilot hole for forming the raise 24. In one embodiment such an initial raise can be bored to a four foot diameter.

Upon explosive expansion of formation in the retort site, gas is also vented through holes through the horizontal sill pillar 22 which remains unfragmented. Much of this gas is vented through the hole resulting from forming the initial raise 25. This hole and others through the horizontal sill pillar have a total cross-sectional area appreciably less than drifts or other similar means for access leading to the underground base of operation 20. Thus, the horizontal sill pillar forms a permeable barrier between the retort site and the base of operation and other large cross-section underground workings between the base of operation and daylight. The holes through the sill pillar act as a flow restrictor and and attenuate airblast which would otherwise occur in the underground workings in gas communication with the base of operation.

Thus, the permeable barrier of this invention has a cross-section for gas flow which is substantially smaller than the transverse cross-section of underground workings which provide a means for access to a blast site where formation is explosively expanded when forming an in situ retort. The reduced cross-section of such a permeable barrier temporarily confines gas from such explosive expansion and limits flow of such gas from the retort site to attenuate airblast in underground workings. Such a reduced cross-section for gas flow is provided in underground workings between the blast site and daylight so that the gas flow is vented. The means for access blocked by such a permeable barrier are those which are open to the blast site and which are sufficiently large in transverse cross-section that they would otherwise create a potential for injury to personnel or damage to equipment if airblast in such means for access were not attenuated. Such means for access can be drifts, adits, or other underground workings which are large enough to provide passage for men and equipment used for forming a void in a retort site toward which formation is explosively expanded when forming an in situ retort. In a retort having multiple means for access to the blast site, the blast is confined by providing a permeable barrier between the blast site and each means for access.

FIG. 2 illustrates a completed in situ retort in which shale oil is produced from the fragmented mass 34. The particles at the top of the fragmented mass are ignited to establish a combustion zone at the top of the fragmented mass. Air or other oxygen supplying gas is supplied to the combustion zone from the base of operation 20 through passages 48 extending downwardly from the base of operation through the sill pillar 22 to the top of the fragmented mass. In the retorts shown in FIGS. 3 and 4, similar passages 148 and 248, respectively, form vertically extending gas flow conduits extending between the base of operation and the top of the fragmented mass. Air or other oxygen supplying gas introduced to the fragmented mass through the conduits maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 50 in a portion of the production level access drift 17 beyond the fragmented mass collects liquid products, namely, shale oil 52 and water 54, produced during operation of the retort. A water withdrawal line 56 extends from near the bottom of the sump out through a sealed opening (not shown) in a bulkhead 57 sealed across the access drift 18. The water withdrawal line is connected to a water pump 58. An oil withdrawal line 60 extends from an intermediate level in the sump out through a sealed opening (not shown) in the bulkhead and is connected to an oil pump 62. The oil and water pumps can be operated manually or by automatic controls (not shown) to remove shale oil and water separately from the sump. The inlet of a blower 64 is connected by a conduit 66 to an opening through the bulkhead 57 for withdrawing off gas from the retort. The outlet of the blower 64 delivers off gas from the retort through a conduit 68 to a recovery or disposal system (not shown).

What is claimed is:

1. A method for attenuating airblast in adjacent underground workings produced by detonating explosive in a subterranean formation containing oil shale for forming an in situ oil shale retort containing a fragmented permeable mass of formation particles containing oil shale, the method comprising the steps of:

excavating means for access to a retort site in the formation containing oil shale;

excavating at least one void in formation within the retort site, leaving a remaining portion of unfragmented formation within the retort site adjacent the void;

providing a permeable barrier between such a void and any means for access in gas communication with such a void, the permeable barrier having a cross section for gas flow which is substantially smaller than the transverse cross section of such means for access;

placing explosive in such a portion of unfragmented formation;

detonating such explosive for explosively expanding such a portion of unfragmented formation toward such a void for forming an in situ retort containing a fragmented permeable mass of formation particles containing oil shale; and confining gas from such explosive expansion and limiting flow of such gas from the retort site by means of the smaller cross section of such a permeable barrier so as to attenuate airblast in such means for access.

2. The method according to claim 1 in which the permeable barrier provides a cross-section for gas flow which is substantially smaller than the transverse cross-section of means for access between the retort site and daylight.

3. The method according to claim 1 in which such explosive is detonated in a single round to form such a retort containing a fragmented mass.

4. The method according to claim 1 in which such a permeable barrier comprises a fragmented permeable mass of formation particles sufficiently large to resist appreciable movement from such explosive expansion.

5. The method according to claim 1 in which such a void is formed by excavating formation above such a means for access so that fragmented formation particles drop into the means for access and form a pile of such fragmented particles between the void and the means for access.

6. The method according to claim 5 including forming the void by explosively expanding formation within the retort site in increments; and removing fragmented formation particles after each increment, except the last increment which is used to form such a pile of fragmented formation particles.

7. The method according to claim 6 in which such explosive is detonated in a single round to form such a retort containing a fragmented mass.

8. The method according to claim 1 in which such a permeable barrier comprises a fragmented permeable mass of formation particles which substantially completely blocks passage between the void and such a means for access.

9. A method for attenuating airblast in adjacent underground workings produced by detonating explosive in a subterranean formation containing oil shale for forming an in situ oil shale retort containing a fragmented permeable mass of formation particles containing oil shale, the method comprising the steps of:

excavating a means for access to a retort site in the formation containing oil shale;

excavating at least one void in formation within the retort site, leaving a remaining portion of unfragmented formation within the retort site adjacent the void;

providing a permeable barrier between such a void and the means for access for reducing the effective transverse cross-section of the means for access;

placing explosive in such a portion of unfragmented formation; and explosively expanding such a portion of unfragmented formation toward such a void by detonating such explosive in a single round for forming an in situ retort containing a fragmented permeable mass of formation particles containing oil shale, such a permeable barrier having a sufficiently reduced cross-section for gas flow to temporarily confine gas from such explosive expansion and to vent gas from such explosive expansion to attenuate airblast in such a means for access.

10. The method according to claim 9 in which the permeable barrier comprises a fragmented permeable mass of formation particles placed in the means for access.

11. The method according to claim 9 in which the permeable barrier comprises a fragmented permeable mass of formation particles sufficiently large to resist appreciable movement from such explosive expansion.

12. The method according to claim 9 in which the permeable barrier comprises a fragmented permeable mass of formation particles which substantially completely blocks passage between the void and such a means for access.

13. The method according to claim 9 including providing such a permeable barrier between the void and each means for access to the void; and confining gas from such explosive expansion and limiting flow of such gas to each means for access by restricting such gas to flow through such a permeable barrier.

14. The method according to claim 13 in which such a permeable barrier is provided in, and has a cross-section for gas flow substantially smaller in transverse cross-section than, each means for access between the retort site and daylight.

15. The method according to claim 13 in which the permeable barrier comprises a fragmented permeable mass of formation particles placed in each means for access.

16. A method for attenuating airblast in adjacent underground workings produced by detonating explosive in a subterranean formation containing oil shale for forming a an in situ oil shale retort containing a fragmented permeable mass of formation particles containing oil shale, the method comprising the steps of:

excavating a means for access to a lower portion of a retort site within such a formation containing oil shale;

excavating at least one columnar void within the retort site from the means for access, the columnar void having a height substantially similar to that of the retort being formed, and leaving a remaining portion of unfragmented formation within the retort site adjacent the void, the means for access providing passage to a lower portion of the columnar void;

providing in such passage a permeable barrier having a cross-section for gas flow which is substantially smaller than the transverse cross-section of the means for access;

placing explosive in such a portion of unfragmented formation; and explosively expanding such a portion of unfragmented formation toward such a columnar void by detonating such explosive in a single round for forming an in situ retort containing a fragmented permeable mass of formation particles containing oil shale, such a permeable barrier having a sufficiently reduced cross-section for gas flow to temporarily confine gas from such explosive expansion and to vent gas from such explosive expansion to such a means for access for attentuating airblast in such means for access.

17. The method according to claim 16 including providing such a permeable barrier between the void and each means for access to the void; and confining gas from such explosive expansion and limiting flow of such gas to each means for access by restricting such gas to flow through such a permeable barrier.

18. The method according to claim 16 in which the permeable barrier comprises a fragmented permeable mass of formation particles placed in the means for access.

19. The method according to claim 16 in which the void is formed by excavating formation above such a means for access so that fragmented formation particles drop into the means for access and form a pile of such fragmented particles between the void and the means for access.

20. The method according to claim 19 including forming the void by explosively expanding formation within the retort site in increments; and removing fragmented formation particles after each increment, except the last increment which is used to form such a pile of fragmented particles.

21. The method according to claim 20 in which the pile of fragmented particles providing the permeable barrier substantially completely blocks passage between the void and such means for access.

22. A method for attenuating airblast in adjacent underground workings produced by explosively expanding a portion of a subterranean formation containing oil shale for forming an in situ oil shale retort containing a fragmented permeable mass of formation particles containing oil shale, the method comprising the steps of:

excavating means for access to a retort site in the formation containing oil shale;

excavating a void in formation within the retort site including passage between such a void and such means for access, leaving a remaining portion of unfragmented formation within the retort site adjacent the void;

forming a permeable barrier in such passage by placing a pile of fragmented formation particles in such means for access, the permeable barrier having a cross-section for gas flow which is substantially smaller than the transverse cross-section of such means for access;

placing explosive in such a remaining portion of unfragmented formation; and explosively expanding such a portion of unfragmented formation toward such a void by detonating such explosive in a single round for forming an in situ retort containing a fragmented permeable mass of formation particles containing oil shale, the cross-section of such a permeable barrier temporarily confining gas from such explosive expansion and venting gas from such explosive expansion to such means for access for attenuating airblast in underground workings.

23. The method according to claim 22 including providing such a permeable barrier between the void and each means for access to the void; and confining gas from such explosive expansion and limiting flow of such gas to each means for access by restricting such gas to flow through such a permeable barrier.

24. The method according to claim 23 in which each permeable barrier provided by such fragmented particles substantially completely blocks passage between the void and such a means for access.

25. The method according to claim 22 in which the void is formed by excavating formation above such a means for access so that fragmented formation particles drop into the means for access and form a pile of such fragmented particles between the void and the means for access.

26. In a method for forming an in situ oil shale retort in a subterranean formation containing oil shale, in which a means for access is excavated to a retort site in the formation containing oil shale and at least one void is excavated in formation within the retort site, leaving a remaining portion of unfragmented formation within the retort site adjacent the void, and in which explosive is placed in such a portion of unfragmented formation and detonated in a single round to explosively expand such portion of unfragmented formation toward such a void for forming an in situ retort containing a fragmented permeable mass of formation particles containing oil shale, the improvement comprising the steps of:

providing a permeable barrier between such void and such means for access for reducing the effective transverse cross-section of the means for access; and confining gas from such explosive expansion and limiting flow of such gas from the retort site by means of the smaller cross-section of such a permeable barrier so as to attenuate airblast in the means for access.

27. The improvement according to claim 26 in which the permeable barrier provides a cross-section for gas flow which is substantially smaller than the transverse cross-section of means for access between the retort site and daylight.

28. The improvement according to claim 26 in which the permeable barrier comprises a fragmented permeable mass of formation particles placed in the means for access.

29. The improvement according to claim 26 including providing such a permeable barrier between the void and each means for access to the void which is open to daylight; and in which gas from such explosive expansion is confined by flowing through such permeable barriers.

30. In a method for forming an in situ oil shale retort in a subterranean formation containing oil shale, in which at least one means for access is excavated to a retort site in the formation containing oil shale and at least one void is excavated in formation within the retort site, leaving a remaining portion of unfragmented formation within the retort site adjacent the void, and in which explosive is placed in such a portion of unfragmented formation and detonated to explosively expand such portion of unfragmented formation toward such a void for forming an in situ retort containing a fragmented permeable mass of formation particles containing oil shale, the improvement comprising the steps of:

providing a permeable barrier between such void and each means for access for reducing the effective transverse cross section of each means for access; and confining gas from such explosive expansion by limiting flow of such gas from the retort site by means of the smaller cross section available for gas flow through such a permeable barrier so as to attenuate airblast in each means for access.

31. The improvement according to claim 30 in which each means for access in which gas is confined extends between the retort site and daylight.

32. A method for attenuating airblast in adjacent underground workings produced by detonating explosive in a subterranean formation containing oil shale for forming an in situ oil shale retort containing a fragmented permeable mass of formation particles containing oil shale, the method comprising the steps of:

excavating means for access to a retort site in the formation containing oil shale;

excavating at least one void in formation within the retort site, leaving a remaining portion of unfragmented formation within the retort site adjacent the void;

providing a permeable barrier between such a void and any means for access in gas communication with such a void, the permeable barrier having a cross section available for gas flow which is smaller than the transverse cross section of such means for access;

placing explosive in such a portion of unfragmented formation;

detonating such explosive for explosively expanding such a portion of unfragmented formation toward such a void for forming an in situ retort containing a fragmented permeable mass of formation particles containing oil shale; and confining gas from such explosive expansion and limiting flow of such gas from the retort site by means of the smaller cross section of such a permeable barrier so as to attenuate airblast in such means for access.

33. The method according to claim 32 in which such a permeable barrier comprises a fragmented permeable mass of formation particles sufficiently large to resist appreciable movement from such explosive expansion.

34. The method according to claim 32 in which the void is formed by excavating formation above such a means for access so that fragmented formation particles drop into such a means for access and form a pile of such fragmented particles between the void and the means for access.

35. The method according to claim 32 in which such a permeable barrier comprises a fragmented permeable mass of formation particles which substantially completely blocks passage between the void and such a means for access.

36. A method for attenuating airblast in adjacent underground workings produced by detonating explosive in a subterranean formation containing oil shale for forming an in situ oil shale retort containing a fragmented permeable mass of formation particles containing oil shale, the method comprising the steps of:

excavating a means for access to a lower portion of a retort site within such a formation containing oil shale;

excavating at least one columnar void within the retort site from the means for access, the columnar void having a height substantially similar to that of the retort being formed, and leaving a remaining portion of unfragmented formation within the retort site adjacent the void, the means for access providing passage to a lower portion of the columnar void;

providing in such passage a permeable barrier having a cross section available for gas flow which is smaller than the transverse cross section of the means for access;

placing explosive in such a portion of unfragmented formation; and explosively expanding such a portion of unfragmented formation toward such a columnar void by detonating such explosive in a single round for forming an in situ retort containing a fragmented permeable mass of formation particles containing oil shale, such a permeable barrier having a sufficiently reduced cross section for gas flow to temporarily confine gas from such explosive expansion and to vent gas from such explosive expansion to such a means for access for attenuating airblast in such means for access.

37. The method according to claim 36 including providing such a permeable barrier between the void and each means for access to the void; and confining gas from such explosive expansion and limiting flow of such gas to each means for access by restricting such gas to flow through such a permeable barrier.

38. The method according to claim 36 in which the permeable barrier comprises a fragmented permeable mass of formation particles placed in the means for access.

39. The method according to claim 36 in which the void is formed by excavating formation above such a means for access so that fragmented formation particles drop into the means for access and form a pile of such fragmented particles between the void and the means for access.

40. A method for attenuating airblast in adjacent underground workings produced by explosively expanding a portion of a subterranean formation containing oil shale for forming an in situ oil shale retort containing a fragmented permeable mass of formation particles containing oil shale, the method comprising the steps of:

excavating means for access to a retort site in the formation containing oil shale;

excavating a void in formation within the retort site including passage between such a void and such means for access, leaving a remaining portion of unfragmented formation within the retort site adjacent the void;

forming a permeable barrier in such passage by placing a pile of fragmented formation particles in such means for access, the permeable barrier having a cross section available for gas flow which is smaller than the transverse cross section of such means for access;

placing explosive in such a remaining portion of unfragmented formation; and explosively expanding such a portion of unfragmented formation toward such a void by detonating such explosive in a single round for forming an in situ retort containing a fragmented permeable mass of formation particles containing oil shale, the cross section of such a permeable barrier temporarily confining gas from such explosive expansion and venting gas from such explosive expansion to such means for access for attenuating airblast in underground workings.

41. The method according to claim 40 including providing such a permeable barrier between the void and each means for access to the void; and confining gas from such explosive expansion and limiting flow of such gas to each means for access by restricting such gas to flow through such a permeable barrier.

* * * * *